United States Patent [19]

Kidd

[11] 3,944,959

[45] Mar. 16, 1976

[54] ELECTRICAL CIRCUIT BREAKER

[75] Inventor: Alan Lister Kidd, Southport, England

[73] Assignee: Dorman Smith Switchgear Limited, Preston, England

[22] Filed: Sept. 12, 1974

[21] Appl. No.: 505,225

[30] Foreign Application Priority Data

Oct. 4, 1973 United Kingdom ..... 46290/73

[52] U.S. Cl. ..... 337/82; 335/45; 337/94

[51] Int. Cl.[2] ..... H01H 71/16

[58] Field of Search ..... 337/6, 7, 45, 57, 82, 93, 337/94, 99; 335/42, 45, 176

[56] References Cited

UNITED STATES PATENTS

| | | | |
|---|---|---|---|
| 2,897,319 | 7/1959 | Wolff | 337/82 |
| 2,981,811 | 4/1961 | Steven et al. | 335/45 |
| 3,211,861 | 10/1965 | Freese | 337/82 |
| 3,226,510 | 12/1965 | Thomas et al. | 337/57 |
| 3,708,771 | 1/1973 | Schreckenberg | 337/82 |

*Primary Examiner*—Harold Broome

*Attorney, Agent, or Firm*—Ross, Ross & Flavin

[57] ABSTRACT

In an electrical circuit breaker having a bimetal element which deflects, upon passage of excess currents, to displace a movable member to trip the circuit breaker, an adjustable element, in the form of a wedge, is provided between the bimetal element and the movable member, so that variation of the position of the wedge and the effective thickness thereof between the bimetal element and the movable member varies the amount of deflection of the bimetal element required to trip the circuit breaker.

7 Claims, 3 Drawing Figures

ELECTRICAL CIRCUIT BREAKER

This invention concerns electrical circuit breakers of the kind which include a bi-metal element which becomes heated, and therefore deflects, upon passage of current through the circuit breaker, the deflection which occurs under fault conditions, e.g. upon sustained overload (i.e. sustained passage of current in excess of the rated capacity of the breaker, for example a current of the order of 125 percent of the rated current for a period of two hours), resulting in the the bimetal element displacing a movable member movement of which serves to initiate tripping operation of the circuit breaker.

The use of electrical circuit breakers for the protection of electrical circuits, instead of fuses, is becoming more and more widespread, and as a consequence there is a continuously-expanding demand for circuit breakers for handling respective currents over a very wide current range. It would not be practicable, for economic reasons, to design and manufacture a corresponding range of circuit breakers, since the number of circuit breakers in the range to deal, for example, with a rating range of 700 to 2000 amperes, with a 50 ampere rating difference between the successive breakers in the range, would be of the order of twenty seven.

An object of this invention is to provide a construction of circuit breaker which is of advantage in relation to the problem of providing a range of breakers to deal with a wide range of current ratings, in that it is adapted to be adjusted insofar as its current rating is concerned, so that a single circuit breaker construction can be employed for a number of alternative breaker current ratings in a range.

With this object in view, the present invention provides an electrical circuit breaker of the kind referred to characterised by the provision of an adjustable element for transmitting deflection of the bimetal element to the movable member, said adjustable element comprising a wedge adjustable to vary the position and effective thickness thereof by which the deflection is transmitted and thereby vary the amount of deflection necessary to initiate tripping operation of the circuit breaker.

The wedge is preferably pivotally mounted to enable it to follow the deflections of the bimetal element, and is conveniently disposed to be engaged directly at one side of its taper by the bimetal element or a protuberance or nose thereon and to engage by the other side of its taper with a point (conveniently provided by a calibration screw) connected with the movable member.

The wedge is conveniently adjustable by being mounted upon a slide which is adjustably displaceable in a plane substantially parallel to the plane of the bimetal element.

Means enabling the slide to be displaced manually conveniently comprises a boss eccentrically mounted upon a rotatable knob and located between two confronting thrust surfaces provided at opposite sides of a recess in the slide.

To ensure that the wedge is not susceptible to or sensitive to vibration or shock, such wedge is preferably formed with a counterbalance.

The invention will be described further, by way of example, with reference to the accompanying drawings, in which.

Figure 2:
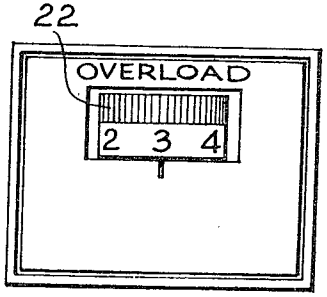
FIG. 2 is a view taken as indicated by arrow II of FIG. 1, illustrating manually-operable adjustment means forming part of the mechanism of FIG. 1.

As shown in the drawings, a tripping mechanism of a three-pole electric circuit breaker conforming to the invention comprises, for each pole, (which poles have been indicated generally by the letters A, B and C), a respective bimetal element in the form of a bimetal strip 10 one end of which is secured to a respective electrical conductor 11 so as to receive heat from such conductor 11 in the event of the latter becoming heated and the other free end of which is formed with a protuberance or nose 12.

Figure 1:
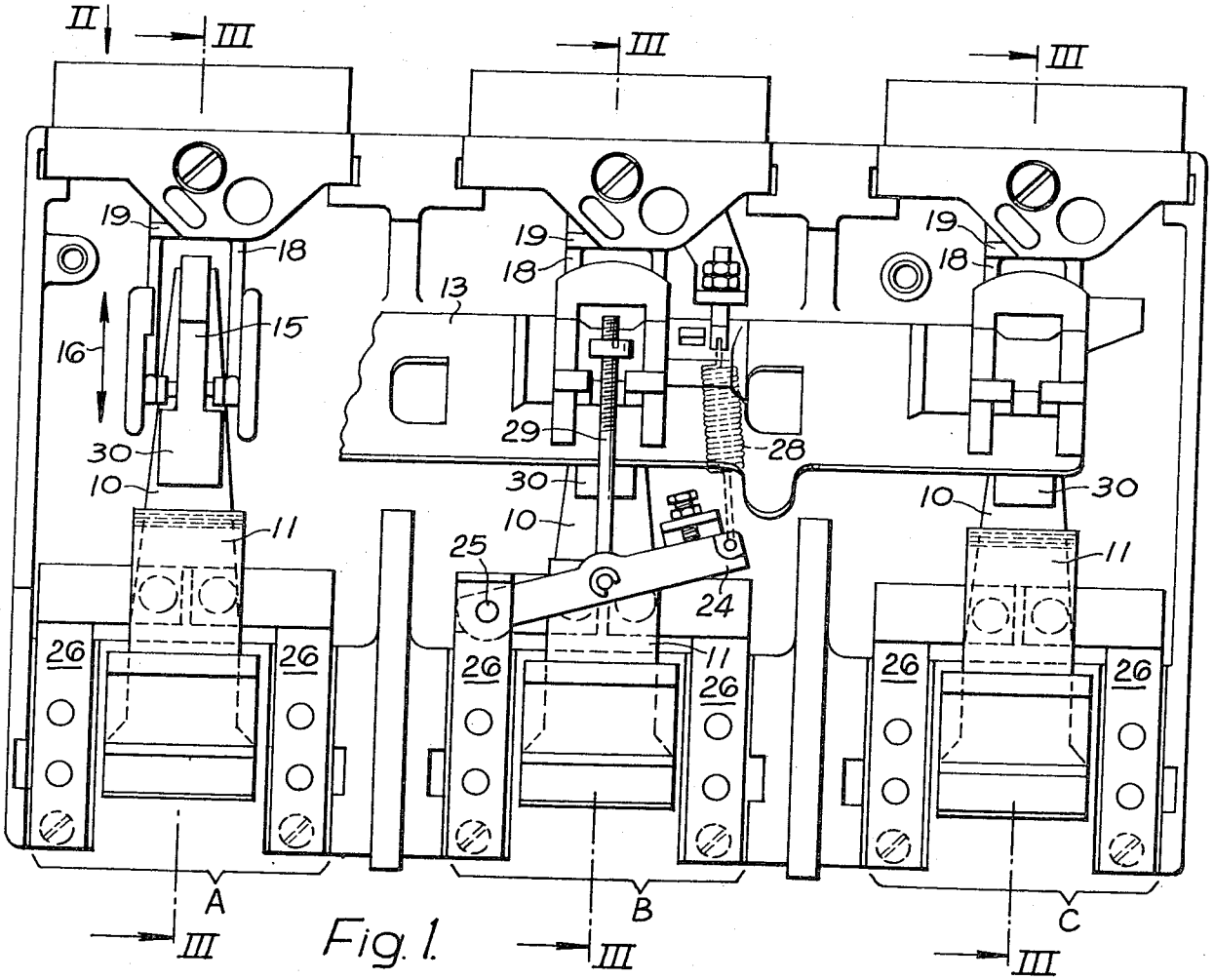
FIG. 1 is an elevation, with certain parts omitted or broken away for clarity, of the tripping mechanism of a three-pole circuit breaker constructed in accordance with the present invention.
Figure 3:
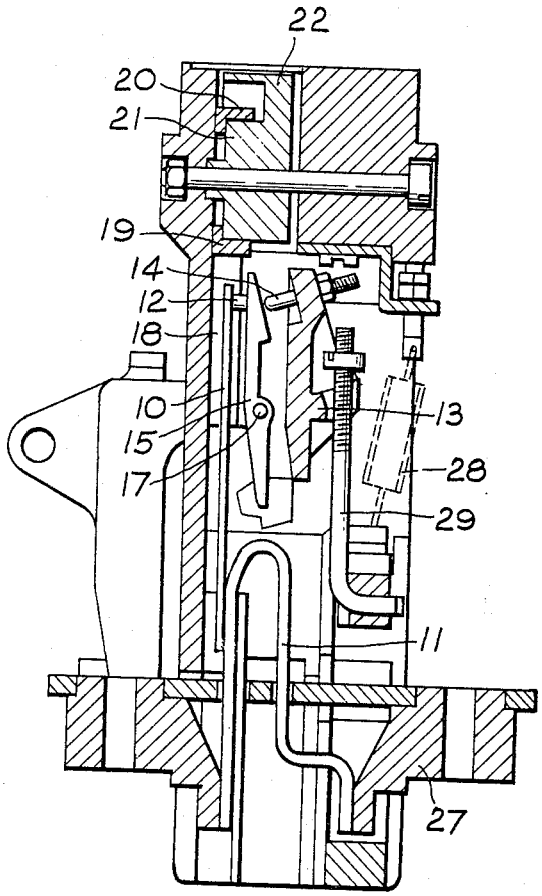
FIG. 3 is a section through the tripping mechanism in correspondence with any one of the poles of the circuit breaker, as indicated by the three section lines III—III of FIG. 1.

Common to the three poles A. B and C is a movable member in the form of a trip bar 13 mounted so as to be pivotable, about an axis extending longitudinally thereof, from the position shown in FIG. 3, through a relatively small angle, in a clockwise direction, to cause tripping of the circuit breaker. This trip bar 13 has been omitted in correspondence with pole A in FIG. 1 to facilitate appreciation of the components of the illustrated embodiment. The trip bar 13 has a respective abutment point, provided by a respective calibration screw 14, projecting towards the protuberance or nose 12 of each of the bimetal strips 10.

In conventional circuit breakers as hitherto proposed, each bimetal strip 10, upon being heated up, engages either directly, or by way of its respective protuberance or nose 12, with the respective abutment point to cause tripping movement of the trip bar 13.

In the illustrated embodiment, and in accordance with the invention, in each pole a respective adjustable element, in the form of a wedge 15, is provided between the respective protuberance or nose 12 and its corresponding calibration screw 14 for transmitting deflection of the bimetal strip 10 to the trip bar 13. This wedge 15, which is adjustably displaceable in a plane substantially parallel to the plane of the respective bimetal strip 10 (as indicated by the double arrow 16 in Fig. 1) to vary the effective thickness thereof by which the bimetal strip's defelction is transmitted and thereby vary the amount of deflection necessary to initiate tripping operation of the circuit breaker, is pivotally mounted, by way of a pivot pin 17, upon a slide 18. Substantially parallel thrust ribs 19, 20 (see FIG. 3), extending transversely of the slide 18 locate one to each side of a cam or eccentric 21 connected to or formed integrally with a respective adjusting knob 22 which is accessible from outside the circuit breaker so as to be manually rotatable about an axis provided by a respective securing bolt 23.

Accordingly, it will be understood that in the assembled condition of the circuit breaker adjustment of the wedge 15, and therefore of the amount of bimetal deflection necessary to trip the breaker (and thus the effective current rating of the breaker), can be effected manually and in a very simple and convenient manner by rotating the knob 22. The extent of edge taper of wedge 15 is conveniently such as to provide for a 20 percent adjustment to each side of a mean or basic design rating for the circuit breaker, so that, for example, a 700 ampere circuit breaker can be adjusted to operate at any selected current in the range from 560 to 840 amperes. From this, it will readily be appreciated that with the use of the invention only a very small number of individually-designed breakers is necessary to provide a series covering a very wide range of current ratings.

The invention is not confined to the precise details of the foregoing example and variations may be made thereto. Thus, it will naturally be understood that the invention is not solely applicable to multi-pole breakers, but can be applied also to single-pole breakers.

Furthermore, in the illustrated case each pole of the breaker includes means for causing tripping upon the occurrence of a short-circuit, which is illustrated fully only in relation to pole B and comprises a respective armature 24 pivoted at 25 and associated with pole pieces 26. The latter become strongly megnetised upon passage of a short circuit current through the respective conductor 11 and/or adjacent conductor 27 thereby to attract the armature 24 and displace it against the bias of a respective spring 28, the armature's movement serving to cause tripping movement of the trip bar 13 by way of a respective draw rod 29. The invention is, however, not restricted to breakers having such an arrangement which may be omitted if desired.

In the illustrated case, each wedge 15 is formed integrally with a counterweight 30 (see FIG. 1) the function of which is to ensure that the wedge 15 remains substantially unaffected by mechanical shocks or vibrations. This counterweight, too, is not essential to the invention and it would be possible to provide a simple wedge arrangement between the bimetal strip 10 and the contact point of the trip bar 13.

I claim:

1. In an electrical circuit breaker including a heat responsive bimetal element with a capacity for deflecting upon passage of current through the circuit breaker with the deflection occuring under fault conditions resulting in a displacement by the bimetal element of a movable member having a movement serving to initiate a tripping operation of the circuit breaker, the improvement comprising: an adjustable element for transmitting deflection of the bimetal element to the movable member, the adjustable element including a wedge adjustable for varying the thickness thereof and increasing or decreasing the amount of deflection of the bimetal element for moving the movable element to cause the tripping, a slide for mounting the wedge and being adjustably displaceable in a plane substantially parallel to the plane of the bimetal element, and means for enabling the slide to be displaced manually including a boss eccentrically mounted upon a rotatable knob and located between two confronting thrust surfaces provided at opposite sides of a recess in the slide, the positioning of the wedge increasing or decreasing the amount of deflection of the bimetal elements for moving the movable member to cause tripping of the circuit breaker.

2. In an electrical circuit breaker including a heat responsive bimetal element with a capacity for deflecting upon passage of current through the circuit breaker with the deflection occuring under fault conditions resulting in a displacement by the bimetal element of a movable member having a movement serving to initiate a tripping operation of the circuit breaker, the improvement comprising: an adjustable element for transmitting deflection of the bimetal element to the movable member, the adjustable element including a wedge adjustable for varying the thickness thereof by which the deflection is transmitted and thereby varying the amount of deflection necessary to initiate tripping operation of the circuit breaker.

3. An electrical circuit breaker as claimed in claim 2 wherein the wedge is pivotally mounted to enable it to follow the deflections of the bimetal element.

4. An electrical circuit breaker as claimed in claim 2 wherein the wedge is disposed to be engaged directly at one side of its taper by the bimetal element or a protuberance or nose thereon, and to engage by the other side of its taper with a point connected with the movable member.

5. An electrical circuit breaker as claimed in claim 4 wherein the point is provided by a calibration screw.

6. An electrical circuit breaker as claimed in claim 2 wherein the wedge is adjustable by being mounted upon a slide which is adjustably displaceable in a plane substantially parallel to the plane of the bimetal element.

7. An electrical circuit breaker as claimed in claim 6 wherein means enabling the slide to be displaced manually comprises a boss eccentrically mounted upon a rotatable knob and located between two confronting thrust surfaces provided at opposite sides of a recess in the slide.

* * * * *